United States Patent [19]

Conti

[11] Patent Number: 5,057,978

[45] Date of Patent: Oct. 15, 1991

[54] SHOWCASE LIGHTING FIXTURE

[76] Inventor: Mario W. Conti, 7044 Estrella Del Mar Rd., Carlsbad, Calif. 92009

[21] Appl. No.: 439,350

[22] Filed: Nov. 20, 1989

[51] Int. Cl.[5] ..... A47F 11/10

[52] U.S. Cl. ..... 362/125; 362/232; 362/240; 362/247; 312/223

[58] Field of Search ..... 362/125, 240, 227, 232, 362/249, 247, 255, 277, 282, 318, 322; 312/223

[56] References Cited

U.S. PATENT DOCUMENTS

| | | | |
|---|---|---|---|
| 4,271,458 | 6/1981 | George, Jr. | 362/240 |
| 4,425,610 | 1/1984 | Krubsack et al. | 362/270 |
| 4,607,317 | 8/1986 | Lin | 362/249 |
| 4,639,841 | 1/1987 | Salestrom et al. | 362/227 |
| 4,665,470 | 5/1987 | George, Jr. | 362/240 |
| 4,739,454 | 4/1988 | Federgreen | 362/277 |
| 4,748,545 | 5/1988 | Schmitt | 362/232 |
| 4,748,548 | 5/1988 | Barton | 362/249 |
| 4,802,074 | 1/1989 | Puschkarski | 362/287 |
| 4,845,601 | 7/1989 | Podbury et al. | 362/125 |
| 4,858,088 | 8/1989 | Agabekov | 362/249 |

FOREIGN PATENT DOCUMENTS

| | | | |
|---|---|---|---|
| 22439 | 1/1921 | France | 362/125 |

OTHER PUBLICATIONS

Xanadu, Litelab Corp., 1975.

*Primary Examiner*—Ira S. Lazarus
*Assistant Examiner*—Richard R. Cole

[57] ABSTRACT

A showcase lighting fixture employs a lighting strip of parallel connected, low-voltage halogen lamps within a modular tubular fixture. The fixture is engaged by socket members which can be affixed to the interior surfaces of a showcase and powered by separate conductors connected to a transformer. In one embodiment, the conductors are rods capable of supporting the fixture. Spring clips in the socket members engage terminal posts in the fixture to secure the fixture and power the lamps. A limited rotation of the fixture relative to the socket members permits direction of the illumination.

4 Claims, 3 Drawing Sheets

SHOWCASE LIGHTING FIXTURE

The present invention relates to illuminating systems and, more particularly, to a lighting system adapted for show and display cases in which the fixture and wiring therefor is substantially unobtrusive and inconspicuous.

BACKGROUND OF THE INVENTION

Showcases of the prior art have generally required lighting fixtures that were bulky and which were designed to use standard base incandescent bulbs. Other fixtures were designed to use tubular incandescent bulbs to reduce the overall bulk. These fixtures generally were powered with normal 110 v. a.c. and the quality of light was limited by the incandescent spectrum.

Prior art showcase fixtures occasionally employed spotlights, specialty lamps and even fluorescent fixtures, but these, too, were powered by 110 v. a.c. and required special wiring. In the older, wooden showcases with glass windows, there were many places that were not obvious to the onlooker in which the Wiring could be placed and the fixtures mounted.

However, with the advent of modern showcases with the extensive use of glass or clear plastic sheets on the top and sides of the showcase, it became difficult to install prior art fixtures in an inconspicuous manner where the installation could be unobvious. Moreover, in the close quarters of a showcase interior, it was generally a difficult task to replace bulbs that were burned out.

With the advent of the low-voltage halogen lamp, some showcase fixtures have been designed to take advantage of the brightness and reduced power consumption afforded by such lamps. However, these fixtures have tended to be bulky, using the larger, higher wattage halogen lamps which generate both heat and ultra violet radiation.

What has been needed, and what is supplied by the present invention is an improved showcase light fixture that can provide superior illumination at safer, lower wattage power levels, that is easy to install with unobtrusive mountings, whose wiring is substantially inconspicuous and which is easily re lamped when bulbs burn out.

SUMMARY OF THE INVENTION

According to the present invention, a low voltage lighting strip, such as is described in the copending application of Mario Conti, Ser. No. 07/393,045 now U.S. Pat. No. 4,934,965 , a continuation-in-part of Ser. No. 07/225,079, now abandoned, is contained in a special housing with a rod-like terminal at either end. These terminals are removably inserted into clips of socket members which are connected to the output terminals of a low voltage transformer through either supporting rods or through inconspicuous wires which can follow interior corners of the showcase to the base of the showcase.

As taught in the copending Conti application, the strip can contain a plurality of low voltage, halogen lamps of high intensity which are connected in parallel. Failure of one lamp does not affect the others in the strip. Further, since even relatively low wattage halogen lamps can generate some heat, the entire housing can be easily removed and replaced with a fresh unit. The failed bulb can easily be replaced and the repaired unit is then available to replace the next unit that fails.

In alternative embodiments, the socket members can be adhered directly to the sides of the showcase or, can be supported by thin rods which can either be conductors or may house conductors. According to the present invention, one supporting rod and/or conductor is of a first polarity and the opposite rod and/or conductor is of the opposite polarity. Accordingly, with the combination of low voltage and widely spaced conductors of opposite polarity, the danger of electrical shock or other consequence of touching an exposed conductor is negligible and the unit may be considered extremely safe for use in a commercial establishment.

In other, alternative configurations, the socket members can be adhered to the top of the showcase or to the front or rear panels of the showcase. It is also possible to mount the fixture vertically. In other embodiments, more than one lighting strip can be serially connected, end-to-end with or without intermediate support elements. If intermediate supports are needed, they can be attached directly to the case.

The length of individual lighting strips can be varied to suit a particular application. Accordingly, the lighting fixture of the present invention can be used in all sizes and shapes of show cases, including, without limit, those showcases that are transparent on all faces. Further, the transformer that converts the normal 110 volt a.c. to the lower voltages used by the lighting strips, can either be incorporated into the base or other non visible part of the showcase or can be integral with a plug that is inserted into a 110 volt a.c. receptacle.

Other novel features which are believed to be characteristic of the invention, both as to organization and method of operation, together with further objects and advantages thereof, will be better understood from the following description considered in connection with the accompanying drawings in which several preferred embodiments of the invention are illustrated by way Of example. It is to be understood, however, that the drawings are for the purpose of illustration and description only, and are not intended as a definition of the limits of the invention.

DETAILED DESCRIPTION OF THE DRAWINGS

Figure 1:
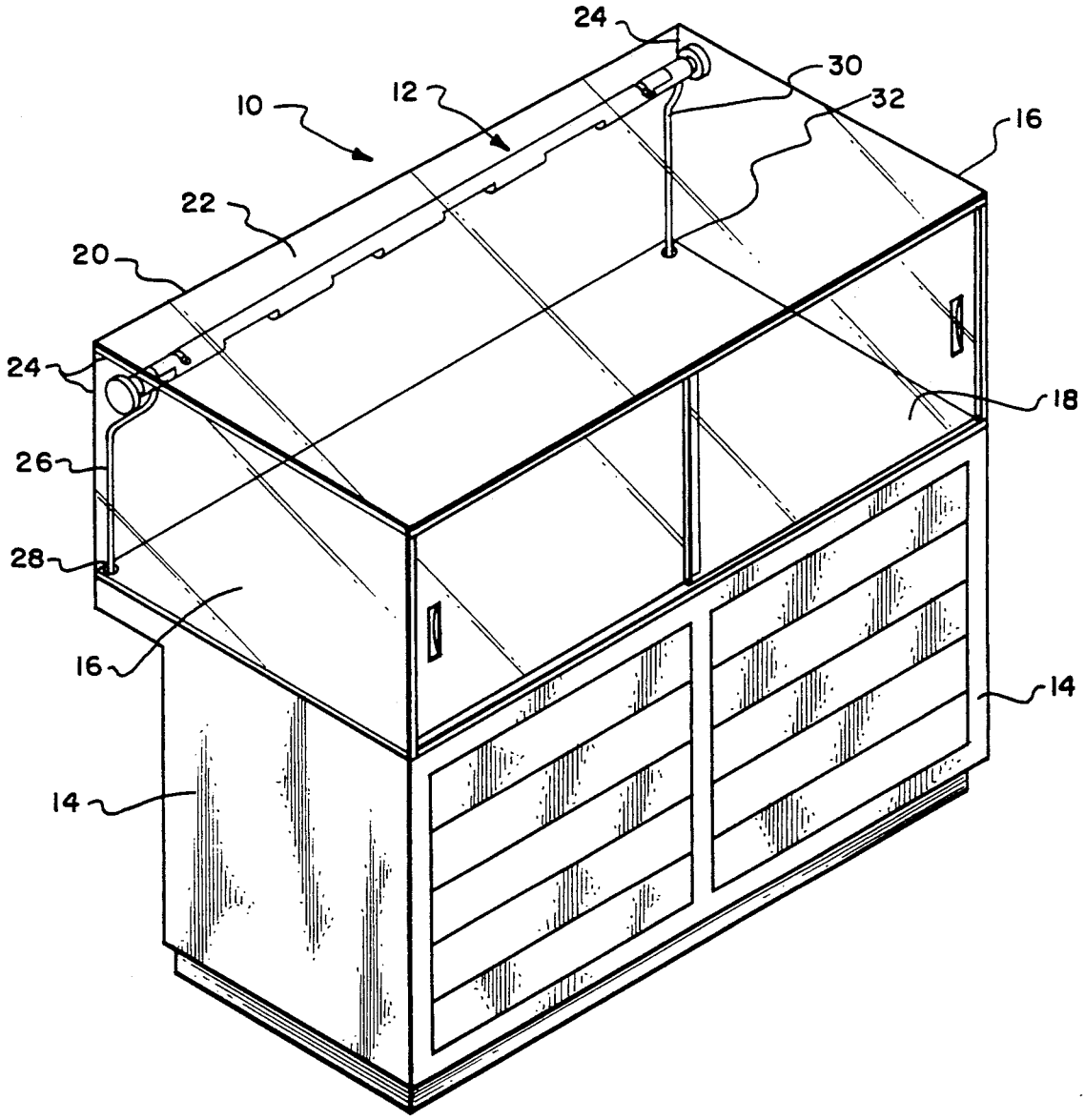
FIG. 1 is a perspective view of a showcase in which a lighting fixture of the present invention is installed.

Turning first to FIG. 1, there is shown a display or showcase 10 containing a display lighting fixture 12 according to the present invention. The display case 10 includes a base sides 16, a back 18 which may or may not be transparent, a front 20 and a top 22 which usually is transparent.

As shown, the showcase 10 is constructed by adhering the edges 24 of the several sides together into an integral unit. A conductor 26 of a first polarity is connected to the fixture 12 at one end and is positioned against the nearest edge 24. The conductor 26 extends from the fixture 12 to the base 14 and through an aperture 28 into a concealed portion of the showcase 10. A second conductor 30 of a second polarity is connected to the opposite end of the fixture 12 and extends along an edge 24 and through a second aperture 32 into the concealed portion of the showcase.

The conductors 26, 30 may alternatively be connected to the low voltage terminals of a transformer (not shown) which can be located in the base of the showcase 10 or can exit the showcase 10 to a transformer which may be integral with a plug that fits into a wall receptacle source of 110 v.a.c. power.

In alternative embodiments, the showcase could include a frame into which each of the several sides and the top could be mounted using conventional techniques.

Any showcase structure can be accommodated by the present invention with varying degrees of unobtrusiveness of the wiring. The lighting strips can be considered modules and while preferably in standard lengths, it is possible to create an inventory of strips of varying length to adjust to virtually any showcase size and shape.

Figure 2:
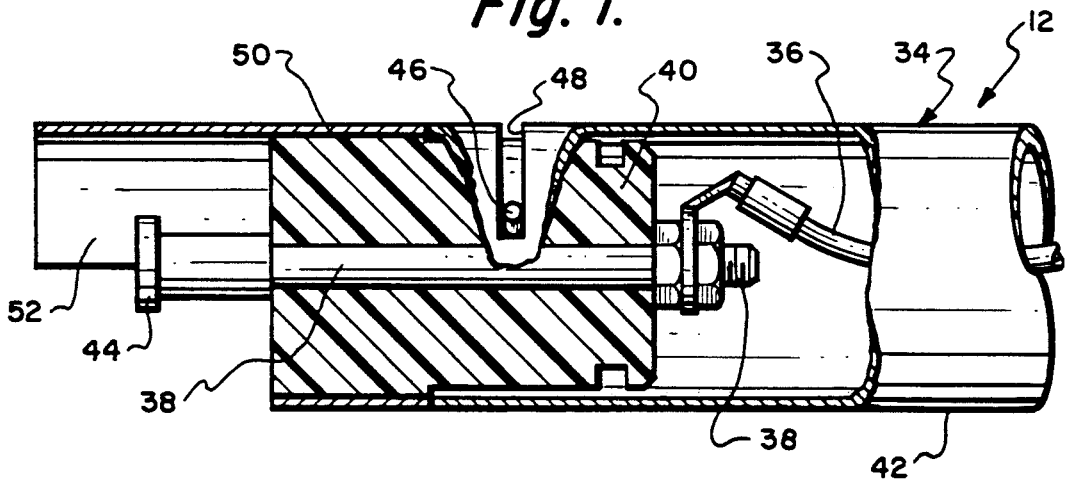
FIG. 2 is an enlarged side section view of the end portion of a light strip according to the present invention.

Turning next to FIG. 2, there is shown one end 34 of the fixture 12 in detail. It is to be understood that the fixture is mechanically symmetrical with respect to the ends thereof. One of the conductors 36 that make up the lighting strip (as disclosed in the Conti application, supra) is connected to one end of a terminal element 38. As shown, the terminal element 38 may be a threaded rod so that the conductor 36 can be terminated in a standard connector.

An apertured, non conducting cylinder 40 supports and isolates the terminal element 38 from the metallic housing 42 that surrounds the lighting strip. The terminal element 38 ends in a post portion 44 that is adapted to fit into a socket element, shown and described in FIG. 3, infra.

In the preferred embodiment, the housing 42 ends adjacent the approximate midpoint of the cylinder 40. This portion of the cylinder 40 is slightly smaller in diameter than the remaining portion and can therefore rotate freely, relative to the housing 42. A pin 46 extends from the cylinder 40 through a slot 48 in the housing 42, thereby limiting the rotation of the housing 42 relative to the cylinder 40. An end cap 50 is securely mounted to the outer portion of the cylinder 40 which has a slightly larger diameter and fits snugly within the end cap 50. A semi circular cut out portion 52 of the end cap 50 is intended to mate with a similar member in the socket element, shown below.

When the fixture 12 is engaged by the socket elements, the pin 46 and slot 48 permit limited rotation of the housing 42 relative to the socket, thereby allowing a redirection of the illumination from the lighting fixture 12.

Figures 3, 4, 6A:
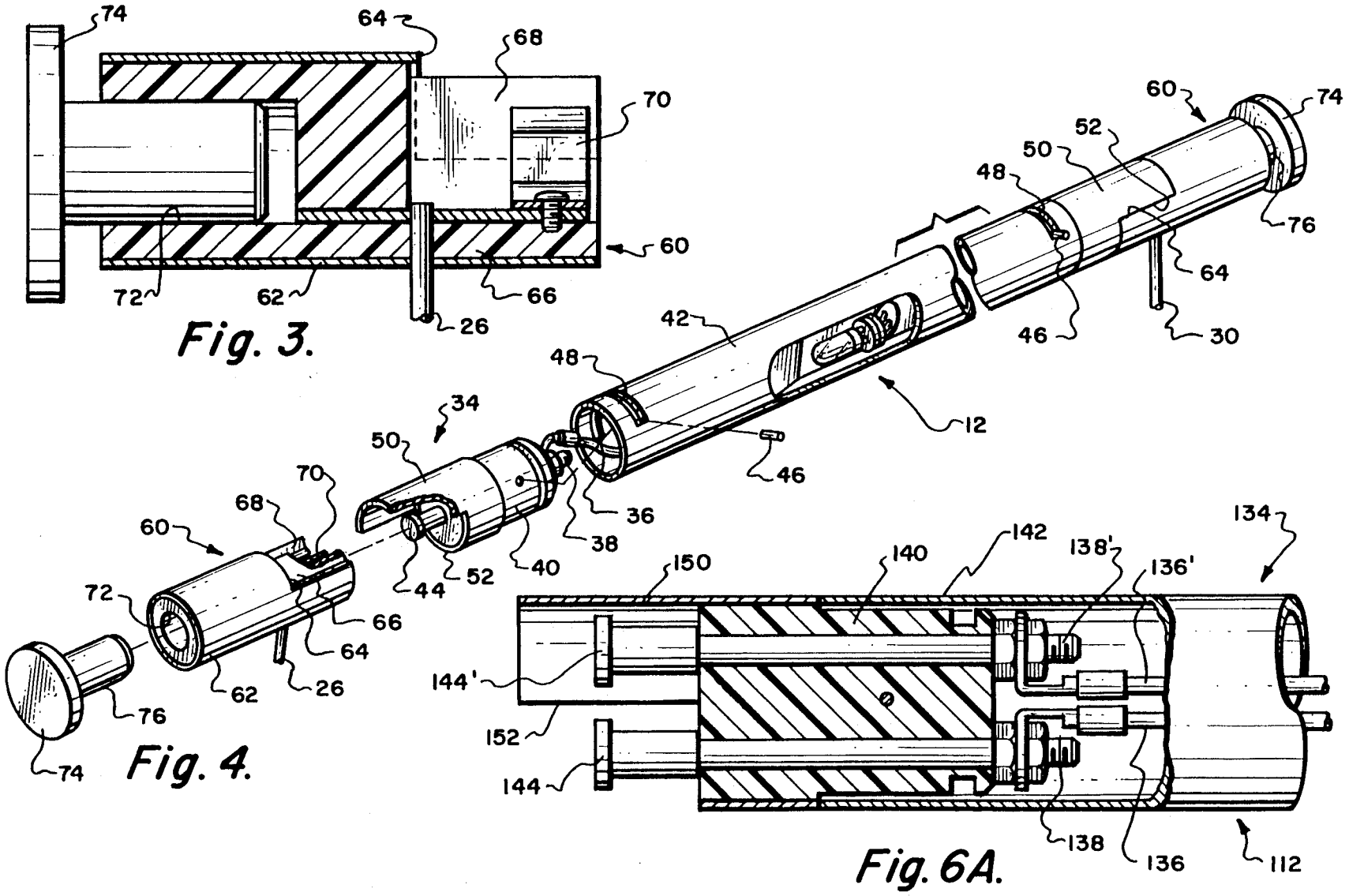
FIG. 3 is an enlarged side sectional view of a socket member according to the present invention.
FIG. 4 is a partially exploded, perspective view of a fixture element including the socket elements.

In FIG. 3. there is shown the corresponding socket element 60 Which is adapted to receive the end cap 50 and post portion 44 of the lighting fixture 12. A housing element 62 is substantially of the same diameter as the end cap 50 and the remainder the housing 42. A corresponding cut out portion 64 is located in the housing element 62, preferably on the upper half thereof so that an end cap 50 can interfit when lowered into place.

An insulating cylinder 66 occupies the interior of the housing element 62. The insulating cylinder 66 has a u-shaped cut out portion 68 to receive post portion 44 and a conductive spring clip 70 is positioned therein to engage post portion 44. A conductor 26, which may be, in alternative embodiments, a wire or a conductive metal rod, is fastened to the socket element 60 and electrically connected to the clip 70.

A large bore aperture 72 is located at the end of the socket element 60 that is opposite to the end containing the clip 70. Depending upon the mode of installation of the fixture 12, the aperture 72 can contain a finishing plug 74 or, if the socket is to be directly connected to a surface, a mounting plug (not shown) which may, using conventional adhesives, be adhered to the surface.

In use, a pair of socket elements 60 are spaced apart by the length of a lighting fixture 12, including the end caps 50 thereof. The post portion 44 are aligned with the clips 70 and the fixture is moved into place with the clips 70 engaging the post portion 44.

Inasmuch as the conductors 26 of the socket elements 60 are each connected to a source of electrical power of opposite polarity, a circuit is created through the lighting strip which has a plurality of light bulbs in parallel. Upon energizing the power source, the several light bulbs within the lighting strip will conduct, thereby providing light to a pre designated area of the showcase.

To better understand the invention, the partially exploded view of FIG. 4 has been included. The reference numerals of the earlier figures have been retained when referring to like parts. However, FIG. 4 shows a mounting plug 76 entering the large bore aperture 72 to enable the installation of the fixture to a wall surface, rather than supporting the fixture by the conductors 26, 30.

Although the embodiment shown in FIG. 4 utilizes the "male" post in the end cap 50 and a "female" clip 70 in the receptacle 60, the elements can easily be reversed to provide a post in the receptacle and a clip in the fixture. The choice is really one of convenience and the alternatives are manifold.

Similarly, the conductors 26, 30 which, in the preferred embodiments are rods, could be ordinary flexible wires which are incapable of supporting the fixture unit 12. Although conductive rods could be bent to a desired shape and yet provide support for a free standing fixture, if it is desired to mount the fixture to the sides or top of the case, more flexible wires might be preferable, which could conform to a surface or profile to enhance unobtrusiveness.

Figures 5, 6B:
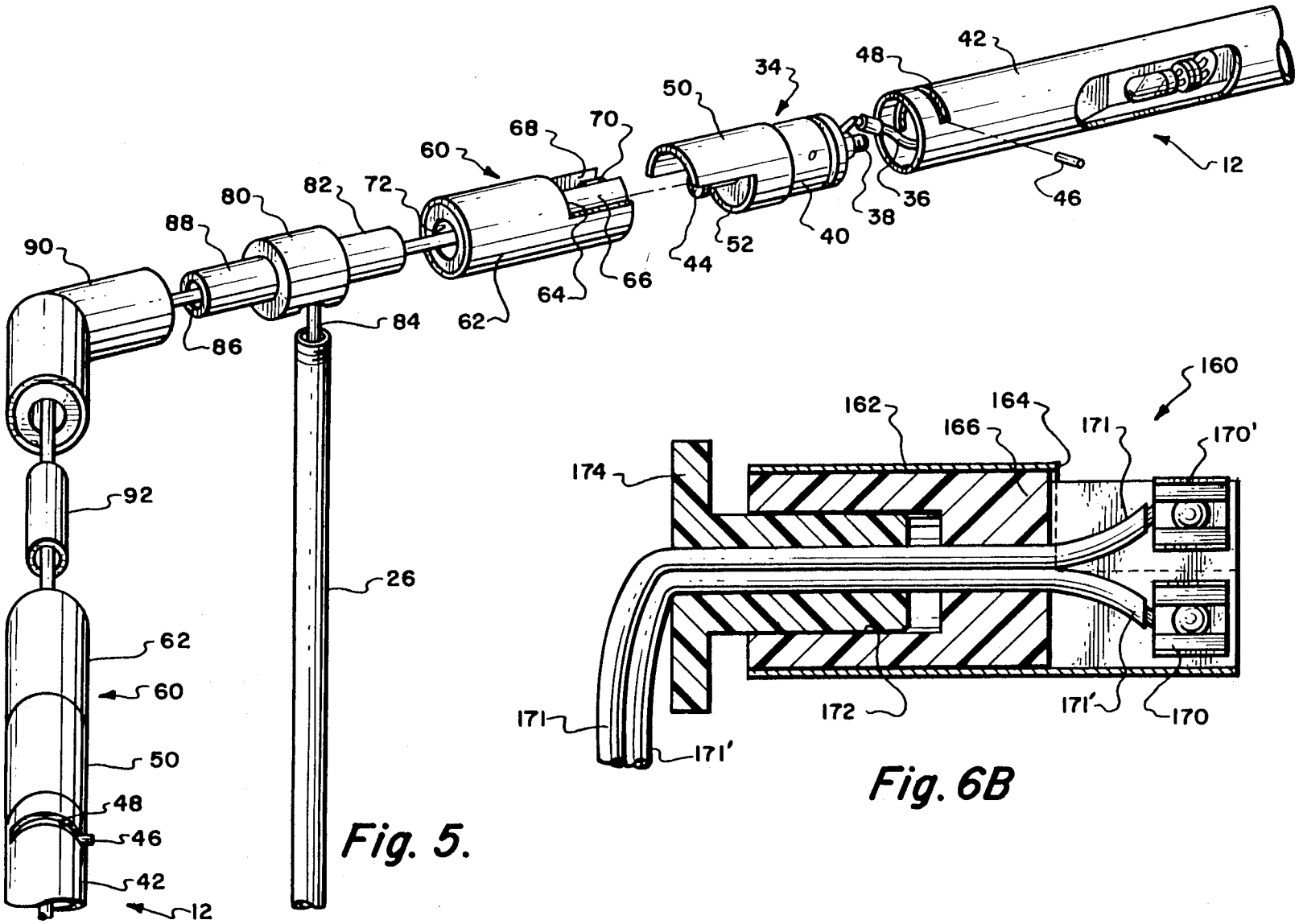
FIG. 5 is a partially exploded perspective view of an alternative installation of a light fixture of the present invention in an angled showcase; and, FIG. 6A and 6B is an enlarged side sectional view of an alternative connector and receptacle element, respectively, which can be used in vertical installations.

Turning next to FIG. 5, there is shown a partially exploded view of an alternative embodiment of a showcase lighting fixture which is modified for use in an angled showcase. As shown, a second lighting fixture is joined to a first fixture to provide an apparently continuous fixture. Utilizing the custom of assigning like numbers to like parts, a first fixture 12 is modified by providing a T-conductor fixture 80 which includes a hollow plug 82 to fit into the large bore aperture 72.

The conductor 26 fits into the T-conductor fixture 80 which includes conductive wire 84 to couple to the spring clip 70. A second conductive wire 86 goes through a second plug 88 into an angled coupler 90. A cylindrical, hollow plug 92 joins the angled coupler 90 to the large bore aperture 72 of yet another lighting fixture 12 and carries the second conductive wire 86 to the spring portion 70 thereof.

As shown, the conductor 26 carries electrical current of a first polarity to at least two lighting fixtures 12. Other lighting fixtures 12 may be serially connected to these fixtures. The last fixture on each end will then be coupled, through a conductor 30, to the electrical current of a second polarity to complete the circuit. If the showcase has a polygonal periphery, additional lighting units may be serially interconnected to meet with a single, second conductor 30 which may be interconnected with the lighting fixtures in the same fashion as the first conductor 26.

Because of the high current carrying capacity of the lighting strips taught in the copending Conti application, a single pair of conductors 26, 30 can serve a plurality of lighting fixtures 12.

Turning finally to FIG. 6A and 6B, there is shown the interfitting fixture and socket elements which are intended for use when only one end can be used to supply power to the lighting elements. FIG. 6A shows the modified end of a fixture element 112 and FIG. 6B shows the modified socket element 160.

As can be seen from FIG. 6A, one modification can utilize a pair of conductors 136, 136' to which are connected to the busses of the lighting strip and which supply power to the lamps. The insulating cylinder 140 has been modified to accommodate the two terminal elements 138, 138' which have posts 144, 144', respectively. The housing 150 includes a cutout portion 152 which mates with a complementary cut out portion of the socket element 160 of FIG. 6B.

The socket element 160 has a housing portion 162 and a cutout portion 164 into which the fixture end 134 is received. A pair of Spring clips 170, 170', respectively receive the posts 144, 144' when the fixture end 134 is engaged by the socket element 160. A pair of conductors 171, 171' are respectively connected to the spring clips 170, 170, and pass through an opening in the insulating cylinder 166 and a similar opening in a modified finishing plug 174 which fits into the large bore aperture 172 of the cylinder 166. The conductors 171, 171' can then go through an appropriate aperture in the showcase to a transformer or other power supply.

The modifications shown in FIGS. 6A and 6B are suitable for use in a vertical installation in which the wiring goes directly into the base of a showcase. Alternatively, the modifications permit the use of the fixture in an installation in which only one end is anchored, or one in which it is undesirable to have conductors at opposite ends of the fixture.

In operation of the preferred embodiment, the socket elements are mounted in the showcase, either by adhering to the interior showcase surfaces or by being supported by the conductive rods. When used with low voltage lamps, the transformer can either be concealed in the base of the showcase or can be integral with the wall plug. The fixture can easily be removed from the socket elements when lamps must be replaced. Further, the modular design permits the interconnection of a plurality of fixtures within a showcase that may have an irregular shape or a substantial enclosed space which must be illuminated.

Other modifications and alterations will become apparent to those skilled in the art based upon the foregoing teaching. Accordingly, the breadth of the invention should be limited only by the scope of the claims appended hereto.

What is claimed as new is:

1. A showcase lighting fixture comprising in combination:

a. A lighting strip including a first conductor, a second conductor and a plurality of lamps connected in parallel therebetween;

b. housing means for enclosing said lighting strip, including a plurality of apertures each aligned with one of said plurality of lamps for transmitting the illumination therefrom, said housing means further including shaped end portions said housing means shaped portions being semi-cylindrical and said complementary shaped portions being semi-cylindrical;

c. first terminal means coupled to one of said conductors and located at one end of said housing means; and d. second terminal mans coupled to the other of said conductors and located at the other end of said housing means;

e. first and second socket receptacles, each having means to engage said first and second terminal means, each of said socket receptacles being adapted to be connected to a source of energy of different polarity, said socket receptacles each including complementary shaped portions to receive said housing means shaped end portions whereby the mating of said housing means and said socket receptacles result in a cylindrical shape;

whereby energy of a first polarity is applied to said first terminal means and energy of a second polarity is applied to said second terminal means for energizing said lamps.

2. The showcase lighting fixture of claim 1, above, wherein said housing means includes a shroud portion surrounding said lamps and end portions, said shroud portion being rotatable relative to said end portions.

3. The showcase lighting fixture of claim 1, above, wherein each said conductor is a conductive rod substantially capable of supporting the showcase lighting fixture.

4. The showcase lighting fixture of claim 1, above, wherein each said conductor is a flexible wire.

* * * * *

UNITED STATES PATENT AND TRADEMARK OFFICE

CERTIFICATE OF CORRECTION

PATENT NO. : 5,057,978

DATED : October 15, 1991

INVENTOR(S) : Mario W. Conti

It is certified that error appears in the above-identified patent and that said Letters Patent is hereby corrected as shown below:

Title page, item (56), Attorney, Agent or Firm, should read --Marvin H. Kleinberg--

Item (73), Assignee, should read --CSL Lighting, Inc.--

Signed and Sealed this

Sixteenth Day of March, 1993

*Attest:*

STEPHEN G. KUNIN

*Attesting Officer*

*Acting Commissioner of Patents and Trademarks*